US006253932B1

(12) United States Patent
Lindsey

(10) Patent No.: US 6,253,932 B1
(45) Date of Patent: Jul. 3, 2001

(54) STRUCTURE FOR STORING ROWING SHELLS

(76) Inventor: Louis G. Lindsey, 125 Alton Ave., San Francisco, CA (US) 94116-1404

( * ) Notice: Subject to any disclaimer, the term of this patent is extended or adjusted under 35 U.S.C. 154(b) by 0 days.

(21) Appl. No.: 09/360,289

(22) Filed: Jul. 22, 1999

(51) Int. Cl.[7] ..... A47F 5/00

(52) U.S. Cl. ..... 211/162; 211/13.1; 211/60.1

(58) Field of Search ..... 211/193, 13.1, 211/162, 1.57, 60.1, 113, 94.01, 87.01; 49/409, 411, 449; 198/347.2, 347.4; 312/201; 414/267, 807; 52/29, 39; 70/95, 100

(56) References Cited

U.S. PATENT DOCUMENTS 1,380,570 * 6/1921 Lehman ..... 211/193
2,812,069 * 11/1957 Trammell ..... 211/193
3,512,654 * 5/1970 Olsen et al. ..... 211/193
3,567,035 * 3/1971 Dudzik ..... 211/13.1
3,906,759 * 9/1975 Schwing et al. ..... 70/100
4,070,979 * 1/1978 Otis et al. ..... 114/267
4,787,804 * 11/1988 Edenas ..... 414/267
4,889,377 * 12/1989 Hughes ..... 211/162
5,076,442 * 12/1991 Hakeem ..... 211/162
5,305,890 * 4/1994 Ishikawa ..... 211/162
5,341,944 * 8/1994 Latino ..... 211/162
5,931,320 * 8/1999 Gajda et al. ..... 211/193
5,938,047 * 8/1999 Ellis et al. ..... 211/1.57
5,967,346 * 10/1999 Price, Jr. ..... 211/162

* cited by examiner

*Primary Examiner*—Daniel P. Stodola
*Assistant Examiner*—Jennifer E. Novosad
(74) *Attorney, Agent, or Firm*—Skjerven Morrill MacPherson LLP

(57) ABSTRACT

A structure to allow an increased number of shells to be stored in a boathouse bay with but a small if any increase in the volume of the boathouse bay. In accordance with one embodiment, shells are stored along both walls of a boathouse bay and on both sides of a movable storage rack vertically mounted to at least one carriage that can move along at least one track beneath the roof of the boathouse. Stored shells are above and/or below each other such that their riggings are interdigitated to conserve space. To remove an interdigitated shell, the movable storage rack can be moved across the boathouse bay to grant access to the shell desired to be used.

11 Claims, 4 Drawing Sheets

STRUCTURE FOR STORING ROWING SHELLS

FIELD OF INVENTION

This invention relates to boathouses and in particular to a structure for storing compactly an increased number of rowing shells in a boathouse.

BACKGROUND OF INVENTION

Boathouses are commonly used to store rowing shells. A typical rowing shell accommodates eight oarsmen and a coxswain. The eight-oar shell has eight outriggers for holding the oars. These outriggers extend approximately two feet to two-and-a-half feet from each side of the shell. The shell itself can be anywhere from approximately twelve (12) to eighteen (18) inches deep and includes typically a fin or a keel on the bottom to assist in stability while steering. The outriggers include a u-shaped vertical member for holding and locking the oar in place on the rigging while allowing the oar to pivot about the mounting point on the rigging of the u-shaped vertical member. Rowing shells for holding four rowers or two rowers are also common and resemble the eight-oar shell in terms of rigging and appearance, but are smaller, reflecting the smaller number of rowers. Likewise, shells of a type usually called sculls (which can accommodate one, two, three or more rowers) are common with rigging on both sides of the shell to handle the two oars used by each rower in the scull.

All of these shells are commonly stored in a boathouse. Unfortunately the rigging extending far out from the shells interferes with storing these shells compactly. Accordingly, a structure and method is needed to allow more efficient use of boathouse space so that a larger number of shells can be stored at lower cost.

SUMMARY

In accordance with this invention, structure is provided to allow an increased number of shells (for example, an increase of 50%, 100%, 150%, 200% or even more in the number of shells) to be stored in a boathouse with but a small, if any, increase in the volume of the boathouse. In accordance with one embodiment of this invention, shells are stored along both walls of a boathouse and, in addition, on one or both sides of two or more standards each mounted to a carriage attached to a track beneath the roof of the boathouse. The number of shells stored on a side of each standard can be the same as the number of shells stored on each side of the boathouse. The shells on one side of each standard are stored at a selected distance above or below up to the same number of shells, if any, stored on the other side of each standard so that the rigging on two adjacent shells stored on opposite sides of each standard can be interdigitated. Thus the rigging on one shell stored on one side of each standard is slightly above or below the rigging on the adjacent shell or shells stored on the other side of a standard. As a result, up to four or five shells (or more) can be stored on each side of a standard with the rigging of the shell or shells on one side interdigitated with the rigging of the shell or shells on the other side of each standard.

Each vertical standard is mounted to hang straight down from a movable carriage located on a track beneath the ceiling. The shells are stored on arms extending essentially horizontally from each standard. These arms are located on each standard such that the shells stored on these arms are capable of being stored next to the shells mounted on the walls of the boathouse. The shells on the side of each standard adjacent to shells stored on essentially horizontal arms extending into the boathouse from a given wall of the boathouse are thus arranged at heights such that the rigging on the shells stored on each standard can be placed above or below the rigging of the adjacent shells stored on the wall of the boathouse. In other words, the rigging on the shells stored on the walls of the boathouse will interdigitate with the rigging on the shells stored on the side of each standard adjacent to that wall of the boathouse, thereby ensuring maximum storage efficiency of the shells. When it is desired to remove a shell stored on the wall of the boathouse adjacent to which the shells stored on the standards are located, the standards are moved across the boathouse on the two or more tracks by a crank or some other well known mechanism such that the oarsmen can access the desired shell on the wall of the boathouse. Similarly, the standards are also moved across the boathouse to allow the oarsmen to access one or more shells stored on the side of the standards adjacent to the wall of the boathouse.

In this manner, shells can be easily removed from storage by appropriately locating the standards, so that oarsmen can reach the shells desired to be used.

The storage structure and system of this invention provide a more compact storage of shells at a lower cost per shell than in the prior art. Accordingly, a boathouse can be used more efficiently by storing a larger number of shells in a given volume of space.

In other embodiments of this invention, the movable standards can contain only one vertical rack of shells. In another embodiment, more than one set of standards can be mounted on a given carriage. In still another embodiment, additional standards can be mounted on added carriages on the same or adjoining tracks.

This invention will be more fully understood in light of the following detailed description taken together with the following drawings.

DETAILED DESCRIPTION OF THE PREFERRED EMBODIMENTS

The following detailed description is illustrative only and not limiting. In the following description, certain definitions will be helpful:

Bay (as in boathouse bay): a room-like area, for storing shells, with an opening through which shells are transported to and from the water. Many boathouses have more than one bay.

Scull: a type of shell in which each rower rows with two oars each in an outrigger extending from each side of the boat.

Shell: a boat in which each rower rows with one oar mounted on an outrigger extending from one or the other side of the boat.

Standard: a vertical structural member, extending from near the ceiling to near the floor, to which arms (supports) are attached to support shells or other items including shelves. Rack: A group of one or more standards which have attachments such as arms or supports to hold shells or other boats or flotation equipment, for example.

Figure 1:
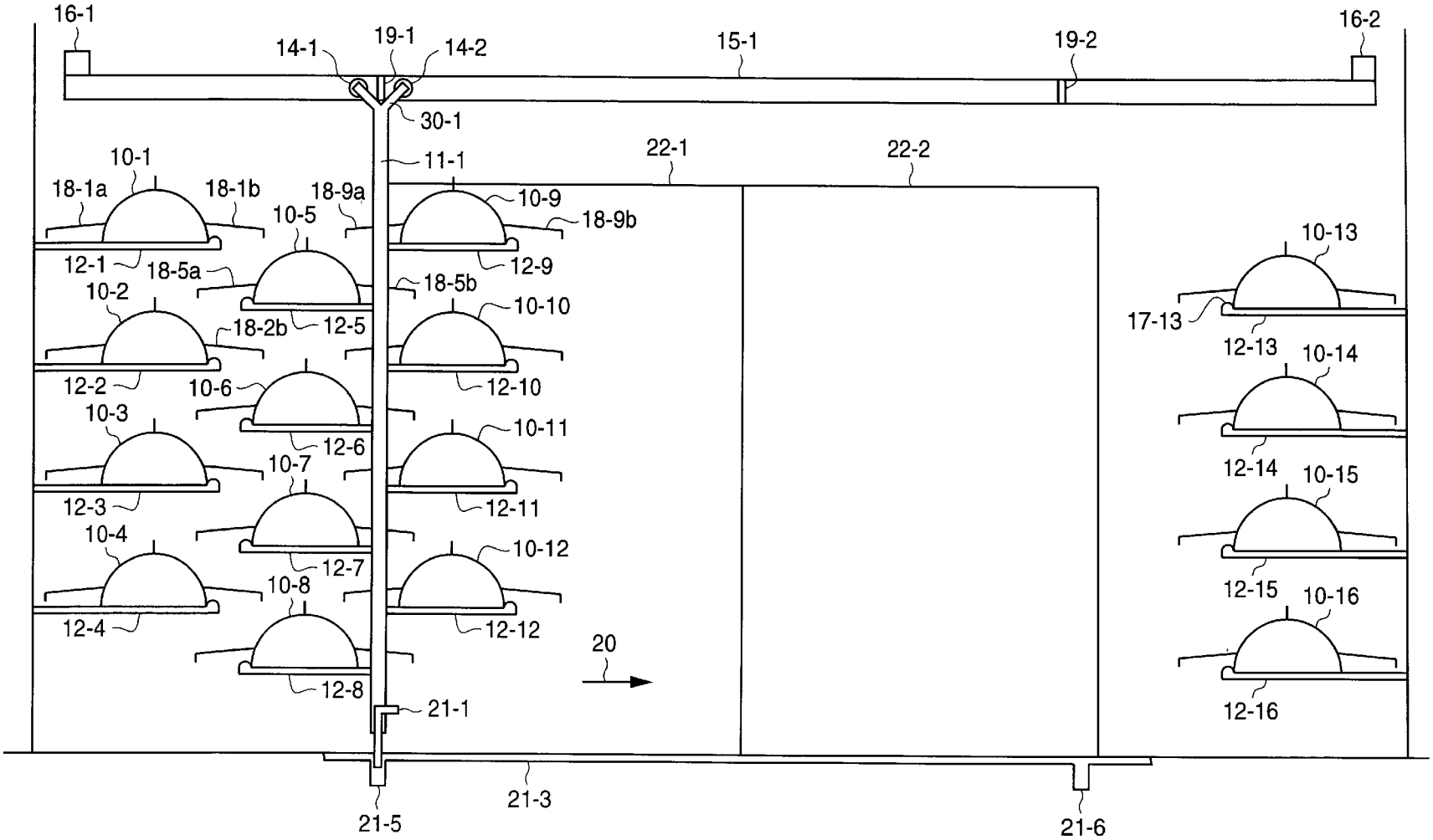
FIG. 1 shows an end view of shells stored in a boathouse in accordance with this invention wherein one movable standard used for storing shells is shown.

FIG. 1 illustrates an end view of a boathouse as seen from the water with the wall of the boathouse facing the water removed. While only one bay is shown in the boathouse of FIG. 1, this invention can be used in a boathouse with two or more bays, if desired. As shown in FIG. 1, in a typical boathouse, shells 10-1 through 10-4 will be mounted on essentially horizontal arms 12-1 through 12-4 attached to and extending into the boathouse from the left hand side of the boathouse bay and shells 10-13 through 10-16 will be mounted on essentially horizontal arms 12-13 through 12-16 attached to and extending into the boathouse from the right hand side of the boathouse bay. If desired, shells can be mounted on only one wall but this may not be the most efficient use of space in the boathouse. A typical shell is about six feet wide from the left most to the right most portions of the rigging and thus a shell normally requires a storage space at least six feet wide. If available space is too narrow, shells can be stored in a tilted manner and carried in and out also in a tilted position. Also, if space is too narrow for the usual aisle width, shells can be tilted as they are removed from the usual horizontal storage position and carried in and out of the bay in a tilted position. Thus an existing bay which might be a little too narrow to accommodate the addition of a set of movable standards can so accommodate those standards when the aisle remaining is too narrow (less than 7 or 8 feet) by carrying the shells in and out of the bay in a tilted position—tilted even as much as 90°.

Typically, arms 12-1 through 12-4 and arms 12-13 through 12-16, upon which the shells are stored, may extend out from the walls of the boathouse and may include lips such as lip 17-13 on arm 12-13 to ensure that each shell will not slide off its storage arms. Thus the prior art boathouse essentially comprises the above-described structures of FIG. 1.

In accordance with this invention, a standard 11-1 comprises a plurality of essentially horizontal arms 12-5, 12-6, 12-7, and 12-8 on the left hand side of standard 11-1 and arms 12-9, 12-10, 12-11, and 12-12 on the right hand side of standard 11-1. Each of arms 12-5 5 through 12-12 is of sufficient length to support a shell, such as shells 10-5 through 10-12. Arms 12-5 through 12-8 extending from standard 11-1 to the left in FIG. 1 are placed at different heights (about a twelve (12) inch difference for standard shells) than arms 12-9 through 12-12 extending to the right from standard 11-1. Arms 12-9 through 12-12 are designed to support shells 10-9 through 10-12 such that their rigging, exemplified by rigging 18-9*a*, will interdigitate with and be slightly above or below the rigging of shells 10-5 through 10-8, exemplified by rigging 18-5*b*, stored on arms 12-5 through 12-8 on the other side of standard 11-1. Accordingly, two more columns of shells that are six (6) feet wide can be stored on opposite sides of a movable standard in an approximately eight (8) feet wide additional space, rather than the twelve (12) feet wide space that normally would be required, without the benefit of interdigitation of the outriggers. And without movable standard 11-1, another access aisle would require still more width of approximately eight (8) or more feet. The added aisle is obviated by the movable standard. Thus the combined saving is twelve (12) feet or more storage width. Thus twenty-eight (28) feet width stores what would otherwise require approximately forty (40) feet. Or with the usual extra aisle space that is often desired a movable set of standards may only require thirty (30) to thirty-two (32) feet instead of forty-four (44) to forty-eight (48) feet. Thus, one bay may store twice as many boats in a width savings of twelve (12) to sixteen (16) feet. The exact space savings will depend on the widths of the boats being stored.

Standard 11-1 is supported on I-beam 15-1 (or any other appropriate structure), which in turn is attached to the roof or other appropriate support members of the boathouse by what is shown in FIG. 1 as supporting beams 16-1 and 16-2. I-beam 15-1, of course, can be supported by any appropriate structure, of a type well known to architects and civil engineers, capable of carrying the loads to be carried by I-beam 15-1. Standard 11-1 is mounted on I-beam 15-1 by a carriage 30-1 including wheels 14-1 and 14-2. Wheels 14-1 and 14-2 will have bearings and smooth surfaces such that standard 11-1 can easily be moved from left to right in accordance with the direction shown by an arrow 20 in FIG. 1 and also from right to left. To prevent sway in standard 11-1, a cane bolt 21-1 at the bottom of standard 11-1 rides in a floor track 21-3 that runs parallel with I-beam 15-1. Cane bolt 21-1 may also be inserted into receivers 21-5 and 21-6 to lock standard 11-1 at one or the other side of the boathouse. The bottom of cane bolt 21-1 can be chamfered (not shown in FIG. 1) so it can ride over minor obstructions in the floor track 21-3. Floor track 21-3 is beneficially mounted over a larger opening in the floor so that accumulated small debris in track 21-3 does not block the movement of cane bolt 21-1 in track 21-3.

When standard 11-1 and a twin standard 11-2 (behind standard 11-1 in FIG. 1 but not shown in FIG. 1: See FIG. 2)are moved to the right, the oarsmen can access shells 10-1 through 10-4 and 10-5 through 10-8 stored on the left wall of the boathouse and the left side of standards 11-1 and 11-2, respectively. of importance, in the position shown for standard 11-1 in FIG. 1, the rigging 18-5*a* on shell 10-5 is interdigitated with the rigging 18-1*b* on shell 10-1 and with the rigging 18-2*b* on shell 10-2. Thus, the rigging 18-5*a* is sufficiently beneath the rigging 18-1*b* on shell 10-1 and above the rigging 18-2*b* on shell 10-2 to allow these three riggings to be interdigitated, thereby again saving approximately two to four feet of lateral storage space in the boathouse. The other riggings on the other shells are not numbered to avoid cluttering the drawing with numbers, but it is apparent from the drawings that the riggings on the right hand side of shells 10-1 through 10-4 are interdigitated with the riggings on the left hand side of shells 10-5 through 10-8. Likewise, the riggings on the right hand side of shells 10-5 through 10-8 are interdigitated with the riggings on the left hand side of shells 10-9 through 10-12.

Of importance to this invention, shells 10-13 through 10-16 are stored on arms 12-13 through 12-16 protruding into the boathouse from the right wall of the boathouse. These shells are located at heights such that the riggings on the left hand side of shells 10-13 through 10-16 will interdigitate and store directly above or below the riggings on the right hand side of shells 10-9 through 10-12 when standards 11-1 and 11-2 are moved to the right hand side of the boathouse. Of interest, to prevent riggings on shells stored on standards 11-1 and 11-2 from hitting or puncturing the hulls of the shells stored on the walls of the boathouse, stops 19-1 and 19-2 are placed on I-beam 15-1 and a corresponding I-beam 15-2 (shown in FIG. 2, but not in FIG. 1) to prevent standards 11-1 and 11-2 from moving further to the left or further to the right, respectively, than the stops. Note, however, that in some embodiments (not shown in the Figures) with additional vertical space between the vertically stored shells, the riggings of shells in one vertical stack will extend over the riggings and at least parts of the bodies or hulls of the shells in the adjacent vertical stack or stacks.

Figure 2:
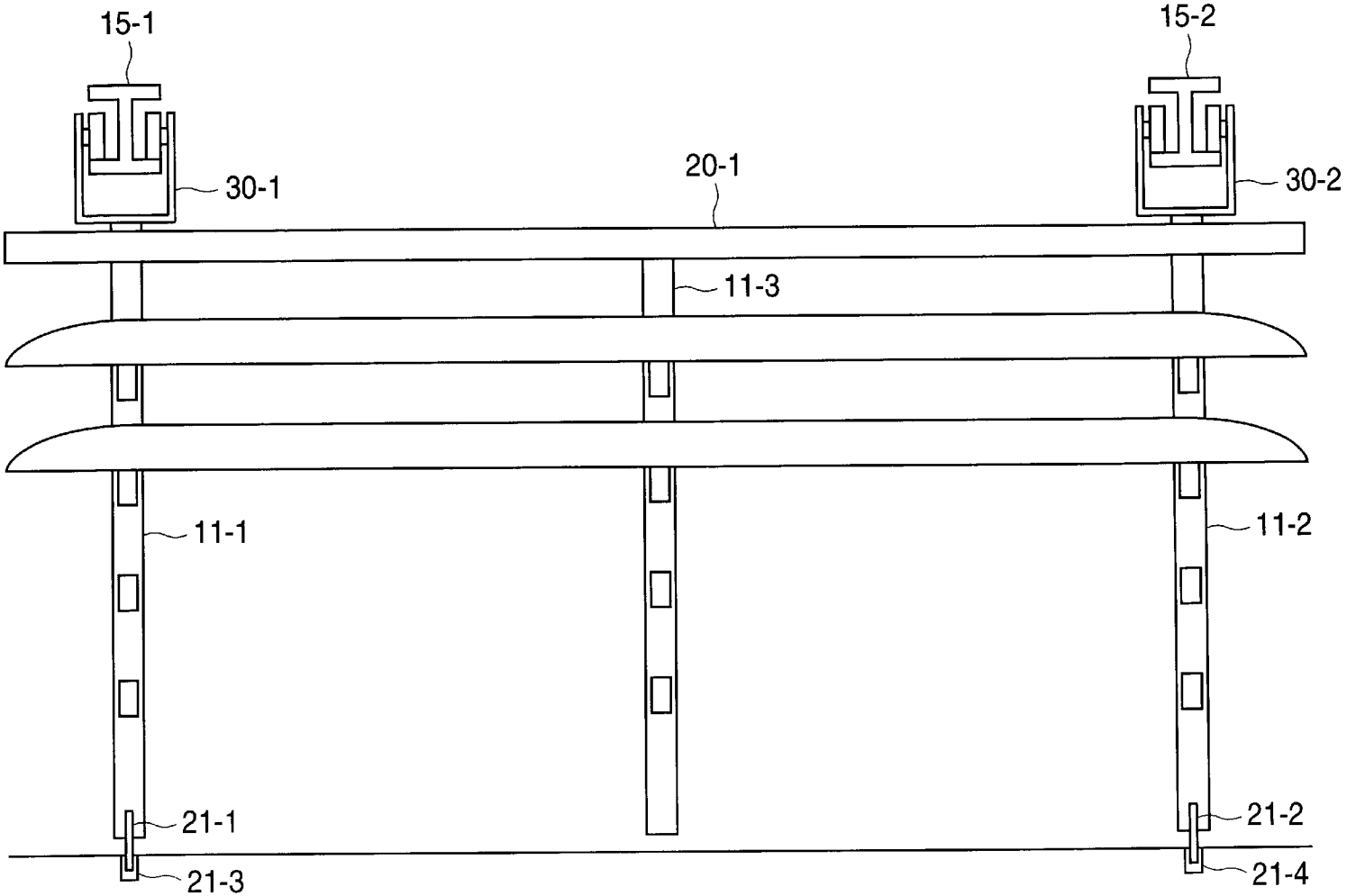
FIG. 2 shows a side view of shells stored on movable standards in accordance with this invention.

FIG. 2 shows a side view of two shells stored in accordance with this invention. Standards 11-1 and 11-2 are shown attached to carriages 30-1 and 30-2, respectively, Carriages 30-1 and 30-2 are mounted on I-beams 15-1 and 15-2, respectively, and can move from one side of the boathouse to the other. Standards 11-1 and 11-2 include cane bolts 21-1 and 21-2, respectively, that ride in floor tracks 21-3 and 21-4, respectively, to prevent sway of standards 11-1 and 11-2 and to lock standards 11-1 and 11-2 in place on one or the other side of the boathouse storage bay.

The location of the standards 11-1 and 11-2 when boats are removed will depend upon the location of the doors leading from the boathouse to the water. In accordance with this invention, two doors 22-1 and 22-2 (FIG. 1) are contemplated for a boathouse bay, each approximately seven-and-a-half (7½) feet or more wide. Thus, door 22-1 would be located as shown in FIG. 1 to the left of the center of the boathouse bay and door 22-2 would be located as shown in FIG. 1 to the right of the center of the boathouse bay.

As shown in FIG. 2, standards 11-1 and 11-2 are mounted on carriages 30-1 and 30-2 respectively. Both carriages are capable of moving along separate I-beams, for example, or suitable rails from one side of the boathouse to the other. Longitudinal beam 20-1, horizontally secured to the top of standards 11-1 and 11-2, is shown running horizontally from standard 11-1 to standard 11-2. Longitudinal beam 20-1 can support one or more additional floating standards such as standard 11-3, which can be placed along longitudinal beam 20-1 wherever required. Floating standard 11-3 allows additional support arms such as arms 12-1 through 12-16 (FIG. 1) to be placed on standard 11-3 to provide additional support for eight-oar shells or to allow the storage of shorter shells or sculls such as what are known as pairs (i.e., shells to be rowed by two rowers) or fours(i.e., shells to be rowed by four rowers). The number of floating standards mounted to longitudinal beam 20-1 is dependent upon the number and variety of shells to be stored in the boathouse. Two or more such floating standards can be used to store two sets of four person shells and a larger number of such floating standards can be used to store pairs or single sculls in the boathouse. Floating standard 11-3 can be used together with standard 11-1 or standard 11-2 to support four person shells, two person shells, or various sculls. Likewise, standard 11-3 can be used to provide additional arms such as arms 12-5 through 12-11 for support of eight-oar shells in the middle to prevent such shells from sagging. Typically, standards 11-1 and 11-2 will each be located as desired approximately one-fifth to one-third of the length of the shell inward from the corresponding ends of the shell to provide adequate support for the shell.

Figure 3:
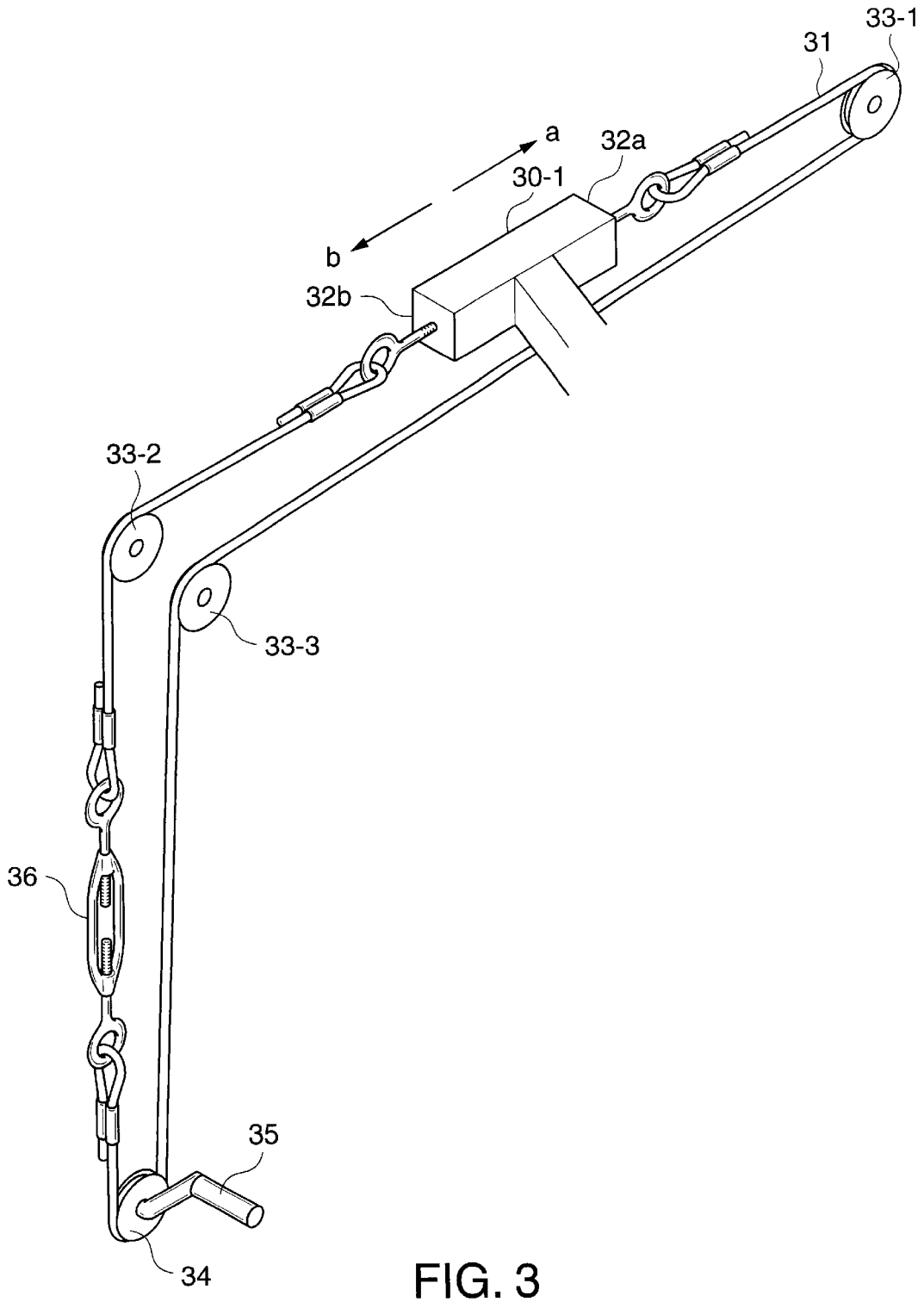
FIG. 3 shows one embodiment of a carriage used for mounting the standards on which shells are stored such that the movable standards can be moved across the boathouse as desired to allow access to selected shells.

FIG. 3 illustrates a mechanism for moving standards 11-1 and 11-2 across the boathouse thereby to allow oarsmen to access shells 10-1 through 10-4 and 10-5 through 10-8 stored on the left wall of the boathouse and the left side of standards 11-1 and 11-2 10 (FIG. 2), respectively. Likewise, when the rowers wish to access shells 10-9 through 10-12 and 10-13 through 10-16, standards 11-1 and 11-2 will be located in the boathouse as shown in FIG. 1. Carriage 30-1 is mounted on an I-beam (not shown) and is connected to a cable or cord 31 that is continuous from end 32*a* of carriage 30-1 to end 32*b* of carriage 30-1. Pulleys 33-1, 33-2, and 33-3 constrain cord 31 while carriage 30-1 is moved in either direction a or b. A crank 34, together with a handle 35, can then be used to move the carriage from one side of the boathouse to the other in a well known manner. A cable tightener 36 of well known design can be provided to properly adjust the tension on the cable so that cable 31 will remain taut and thus allow a user to easily move standards 11-1 and 11-2 across the boathouse. Two such cranks can be turned simultaneously by oarsmen to move standards 11-1 and 11-2 simultaneously across the boathouse or, alternatively, standards 11-1 and 11-2 can be moved automatically across the boathouse by electric motors controlled in a well-known manner to act synchronously.

Figure 4:
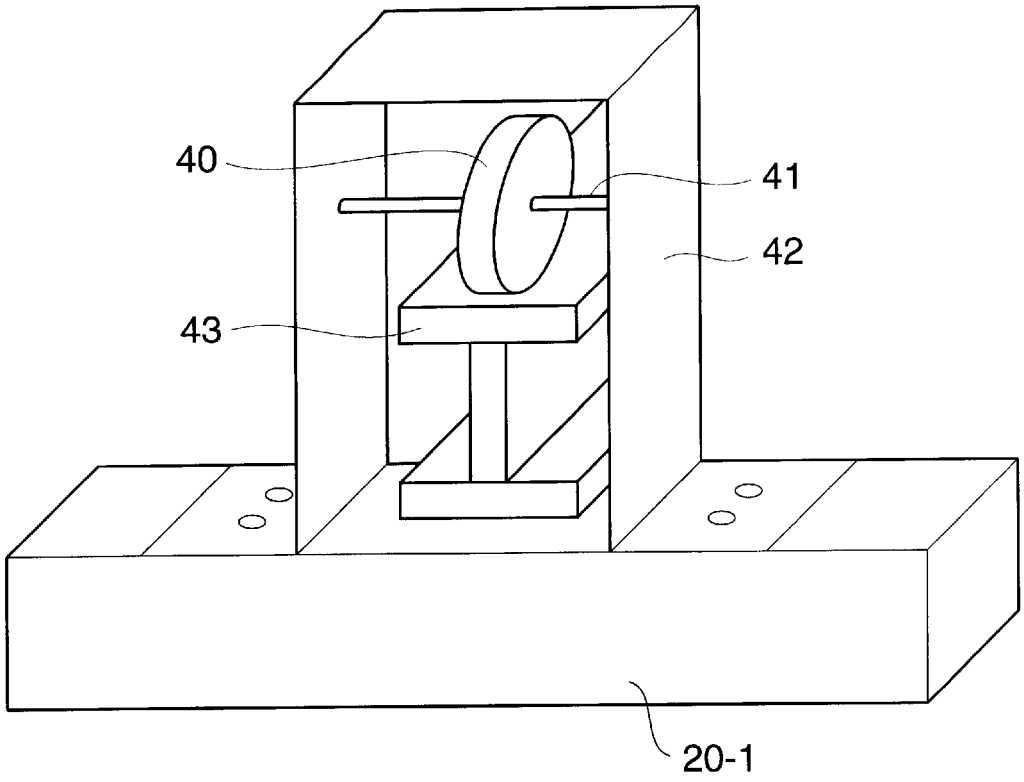
FIG. 4 shows one embodiment of a central beam to support a longitudinal beam attached to the movable standards.

FIG. 4 shows a possible construction utilizing a central I-beam 43 for supporting the middle of longitudinal beam 20-1. I-beam 43 runs parallel to I-beams 15-1 and 15-2 (FIG. 2). Longitudinal beam 20-1 is supported by I-beam 43 through a housing 42 that rides on I-beam 43 with a roller 40 mounted on an axle 41 in housing 42. When standards 11-1 and 11-2 are moved across the boathouse, roller 40 rotates along the top of I-beam 43, thereby supporting the longitudinal beam 20-1 while beam 20-1 is moved across the boathouse.

Other embodiments of this invention will be obvious to those skilled in the art in view of the above description. While one movable storage rack has been shown in one boathouse storage bay, if space is wide enough between the walls of the boathouse, more than one movable storage rack can be used in the boathouse storage bay. While this invention has been described in connection with rowing shells, this invention can be used to store other types of boats or apparatus in a more compact and efficient manner. In particular, sailboats, row boats, motor boats, boats with outriggers and surf boards, for example, can be stored in accordance with the principles of this invention in a manner that will achieve significant savings of space.

I claim:

1. Structure in a boathouse bay, said boathouse bay including a floor and two spacedapart interior walls, the structure comprising:

at least one wall rack associated with at least one wall for storage of boats adjacent at least one of the two interior walls; and at least one movable storage rack, located between said two interior walls, capable of storing boats on at least one side of said at least one movable storage rack, said at least one movable storage rack being capable of being moved across the boathouse bay thereby allowing easy access to the boats stored both on the at least one wall rack of the boathouse bay and on the at least one movable rack.

2. Structure as in claim 1, wherein said at least one movable storage rack includes a plurality of arms extending from at least one side of the at least one movable storage rack, said arms being adapted to store at least one boat.

3. Structure as in claim 1 wherein said at least one movable storage rack includes a plurality of arms extending from both sides.

4. Structure as in claim 3, wherein the wall racks and the at least one movable storage rack are capable of storing rowing shells including rigging and the arms on one side of the at least one movable storage rack are located at a different elevation than the arms on the other side of the at least one movable storage rack.

5. Structure as in claim 4, wherein said at least one movable storage rack includes at least one bolt for locking the movable storage rack in at least one position in the boathouse bay.

6. Structure as in claim 1, wherein said at least one movable storage rack comprises:

two or more vertical standards, each vertical standard containing arms protruding from the standard such that a first number of boats can be stored on one side of the standard and a second number of boats can be stored on the other side of the standard, said arms on the one side of the standard being located at different heightslhan the arms on the other side of the standard.

7. Structure as in claim 6, wherein the arms on said at least one movable storage rack are located such that when said at least one movable storage rack is stored on a given side of the boathouse bay containing a wall rack, any riggings on any boats stored on the side of said at least one movable storage rack adjacent to the wall rack are interdigitated with any riggings on any boats stored on said wall rack.

8. Structure as in claim 1, wherein said at least one movable storage rack includes at least one floating standard capable of providing arms for use in storage of boats thereon.

9. Structure as in claim 8 wherein said at least one floating standard includes arms for the storage of boats thereon.

10. The structure of Structure as in claim 1, wherein said at least one movable storage rack includes at least one pin for locking the at least one movable storage rack in at least one position in the boathouse bay.

11. Structure as in claim 10, in combination with at least one track in the floor with at least one hole defining at least one selected point along the track for receiving said at least one pin thereby to lock the at least one movable storage rack in position at said at least one selected point.

* * * * *